US009097501B2

(12) United States Patent
Gaisbauer

(10) Patent No.: US 9,097,501 B2
(45) Date of Patent: Aug. 4, 2015

(54) EXPLOSIVE MATERIAL CONTAINER

(75) Inventor: Rainer Gaisbauer, Schönau (DE)

(73) Assignee: Rheinmetall Waffe Munition GmbH, Unterlüss (DE)

( * ) Notice: Subject to any disclaimer, the term of this patent is extended or adjusted under 35 U.S.C. 154(b) by 296 days.

(21) Appl. No.: 12/900,339

(22) Filed: Oct. 7, 2010

(65) Prior Publication Data

US 2011/0079163 A1 Apr. 7, 2011

Related U.S. Application Data

(63) Continuation-in-part of application No. PCT/EP2009/001977, filed on Mar. 18, 2009.

(30) Foreign Application Priority Data

Apr. 7, 2008 (DE) ..... 10 2008 017 722

(51) Int. Cl.

| | |
|---|---|
| ***F42B 4/26*** | (2006.01) |
| ***F42B 12/42*** | (2006.01) |
| ***F41J 2/02*** | (2006.01) |
| ***F42B 12/70*** | (2006.01) |

(52) U.S. Cl.
CPC . *F42B 12/42* (2013.01); *F41J 2/02* (2013.01); *F42B 12/70* (2013.01)

(58) Field of Classification Search
USPC ..... 102/344, 343, 331
See application file for complete search history.

(56) References Cited

U.S. PATENT DOCUMENTS 2,389,782 A * 11/1945 Jackson, Jr. ..... 102/344
4,029,014 A 6/1977 Cunningham
5,561,259 A * 10/1996 Herbage et al. ..... 102/334
H1603 H 11/1996 Deckard et al.
5,660,357 A 8/1997 Grossman et al.
5,763,818 A 6/1998 Guymon et al.
6,427,599 B1 * 8/2002 Posson et al. ..... 102/336

(Continued)

FOREIGN PATENT DOCUMENTS

DE 84 01 068 U1 10/1984
DE 38 28 501 C1 10/1989

(Continued)

OTHER PUBLICATIONS

International Search Report of International Application No. PCT/EP2009/001975, issued in co-pending U.S. Appl. No. 12/900,258, completed Jul. 10, 2009, mailed Jul. 21, 2009.

(Continued)

*Primary Examiner* — Troy Chambers
*Assistant Examiner* — Bridget Cochran
(74) *Attorney, Agent, or Firm* — Griffin & Szipl, P.C.

(57) ABSTRACT

An explosive material container (1) for a block of explosive material (7), in particular comprising a protective film (8), is described in which an inflow protection element in the form of a cover (2) with integrated protection, support, guiding and/or positioning functions is provided. The inflow protection cover (2) is, preferably, provided with sealing and/or adhesive material and is placed on two or more edge profiles (3, 4, 5, 6) of the explosive material container (1), on the firing side, on the explosive material block (7) packed in the protective film (8). Positioning tips (9, 9.1) of the inflow protection cover (2) and the explosive material container (1) assume the positioning function.

13 Claims, 2 Drawing Sheets

(56) References Cited

U.S. PATENT DOCUMENTS

| | | | | |
|---|---|---|---|---|
| 6,588,343 | B1 | 7/2003 | Mulinix | |
| 6,634,301 | B1 | 10/2003 | Mulinix | |
| 6,679,174 | B1 | 1/2004 | Mulinix | |
| 6,708,620 | B1 * | 3/2004 | Deckard et al. | 102/336 |
| 7,469,640 | B2 * | 12/2008 | Nielson et al. | 102/336 |
| 8,191,478 | B2 * | 6/2012 | Herbage et al. | 102/352 |
| 2007/0266882 | A1 * | 11/2007 | Gaisbauer et al. | 102/336 |
| 2009/0251353 | A1 | 10/2009 | Bannasch et al. | |
| 2011/0297033 | A1 | 12/2011 | Gaisbauer | |

FOREIGN PATENT DOCUMENTS

| | | | |
|---|---|---|---|
| DE | 690 15 046 | T2 | 4/1995 |
| DE | 199 51 767 | C2 | 6/2002 |
| DE | 10 2004 047 231 | A1 | 4/2006 |
| DE | 601 19 735 | T2 | 4/2007 |
| GB | 2 300 035 | A | 10/1996 |
| WO | 2007/012371 | A1 | 2/2007 |

OTHER PUBLICATIONS

International Search Report issued in corresponding application No. PCT/EP2009/001977, mailed Jul. 17, 2009, completed Jul. 27, 2009.

Webster's New Collegiate Dictionary 404 (1977).

Office Action issued in co-pending related U.S. Appl. No. 12/900,258 on Aug. 17, 2012.

J. Terry White, Supersonic Nightmare, at http://www.whiteeagleaerospace.com/blog/2011/02/21/supersonic-nightmare/ (2011).

Webster's Ninth New Collegiate Dictionary 1072 (1990), relating to the term "sensor", as filed in co-pending related application.

* cited by examiner

EXPLOSIVE MATERIAL CONTAINER

This is a Continuation-in-Part Application ("Continuation Application") in the United States of International Patent Application No. PCT/EP2009/001977 filed Mar. 18, 2009, which claims priority on German Patent Application No. DE 10 2008 017 722.9, filed Apr. 7, 2008. The entire disclosures of the above patent applications are hereby incorporated by reference.

FIELD OF THE INVENTION

Explosive material containers, for example, for smoke functions, are well known from practical use. An explosive material block, or an explosive body, is described, for example, in DE 10 2004 047 231 A1.

BACKGROUND OF THE INVENTION

Submunitions that are composed of such explosive material containers are known, inter alia, from DE 601 19 735 T2.

A method and an apparatus for decoying IR, RF and dual-mode-guided missiles with these submunitions is disclosed in WO 2007/012371 A1; and dual-mode decoys are disclosed in DE 199 51 767 C2. A firing apparatus in a firing chain for a submunition body is disclosed in DE 690 15 046 T2.

The protective film on the explosive material block is often torn off prematurely by the forces that occur on ejection in flight conditions (i.e., by incident flow, in other words, by the airstream).

The object of the present invention is, therefore, to provide a variant of explosive material container that prevents tearing off prematurely of the protective film of the explosive material block by incident flow (i.e., by the airstream) when ejected during flight.

SUMMARY OF THE INVENTION

The object of the invention is achieved by the features of a first embodiment, which pertains to an explosive material container (1) having an explosive material (7), characterized in that an incident-flow protective cap (2) protects the explosive material block (1). Advantageous additional embodiments are specified as follows.

In accordance with a second embodiment of the invention, the first embodiment is modified so that the incident-flow protective cap (2) is fitted over a protective film (8) of the explosive material block (1). In accordance with a third embodiment of the present invention, the first embodiment and the second embodiment are further modified so that the incident-flow cap (2) is preferably provided with a sealing and/or adhesive compound, and is plugged onto two or more edge profiles (3, 4, 5, 6) of the explosive material container (1), on the ejection side on the explosive material block (7).

In accordance with a fourth embodiment of the present invention, the first embodiment, the second embodiment, and the third embodiment are further modified so that this explosive material container, in conjunction with the incident-flow protective cap (2), intrinsically carries out a protective, supporting, guidance and/or positioning function. In accordance with a fifth embodiment of the present invention, the fourth embodiment is further modified so that positioning spikes (9, 9.1) on the incident-flow protective cap (2) and the explosive material container (1) carry out the positioning function.

The invention is based on the idea of including an incident-flow protective cap as incident-flow protection, which closes the explosive material container on the ejection side, interlocked with the explosive material. For this purpose, by way of example, four edge profiles of the explosive material container are pressed against the corners of the explosive material, and the incident-flow prepared cap, which is provided with a sealing and/or adhesive compound, is plugged on the ejection side onto the explosive material block, packed in protective film, with the four edge protective profiles resting thereon. The position spikes in the incident-flow protective cap result in the explosive material block being centered therein and being held in the optimum position for the intended effect. The incident-flow protective cap is itself closed on the ejection side such that it is interlocked with the explosive material container.

In addition to simplification (that is, improved capability for handling the explosive material block), the reduction in sources of defects during assembly is a further advantage provided by the present invention. The incident-flow protection prevents damage to the protective film when the explosive material block is inserted into the casing.

Since vibration, which is known to occur, can no longer directly affect the explosive material blocks packed in the protective film, this also precludes the protective film from being torn into, even in test conditions (e.g., tactical/logistic vibration).

BRIEF DESCRIPTION OF THE DRAWINGS

The invention will be explained in more detail below, with reference to one exemplary embodiment, described with drawings, in which.

DETAILED DESCRIPTION OF THE INVENTION

Figure 1:
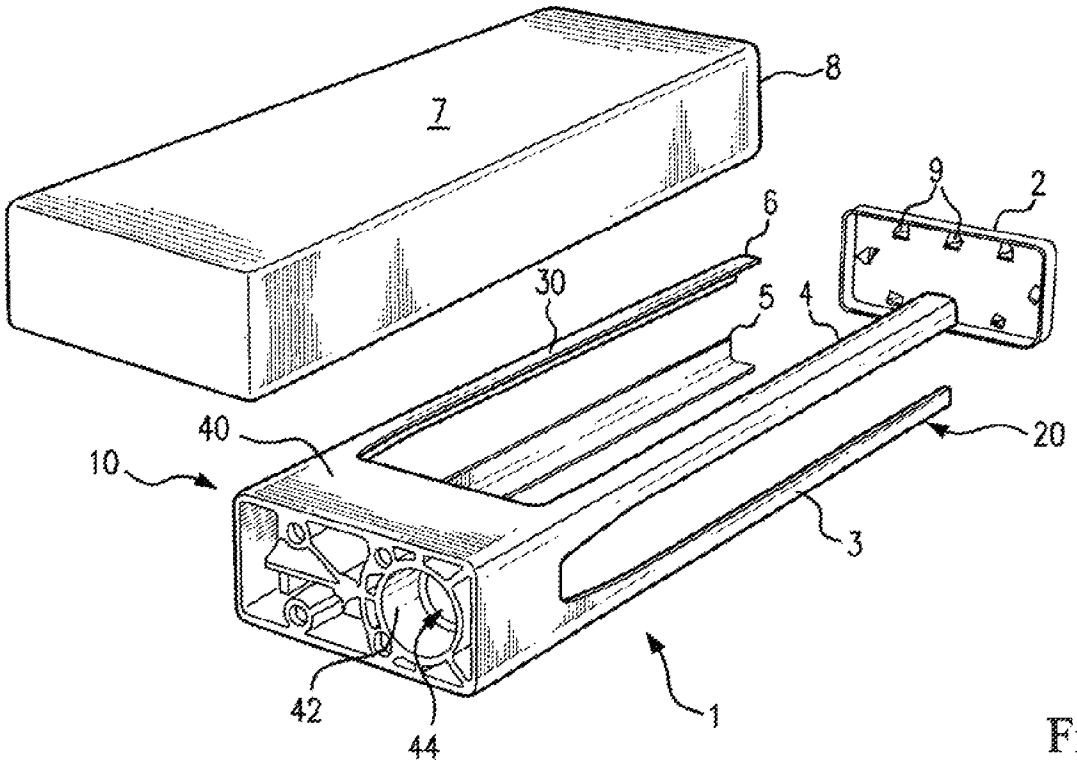
FIG. 1 and FIG. 2 show perspective illustrations of an explosive material container of the present invention, viewed from a firing side and from an ejection side, respectively.
Figure 2:
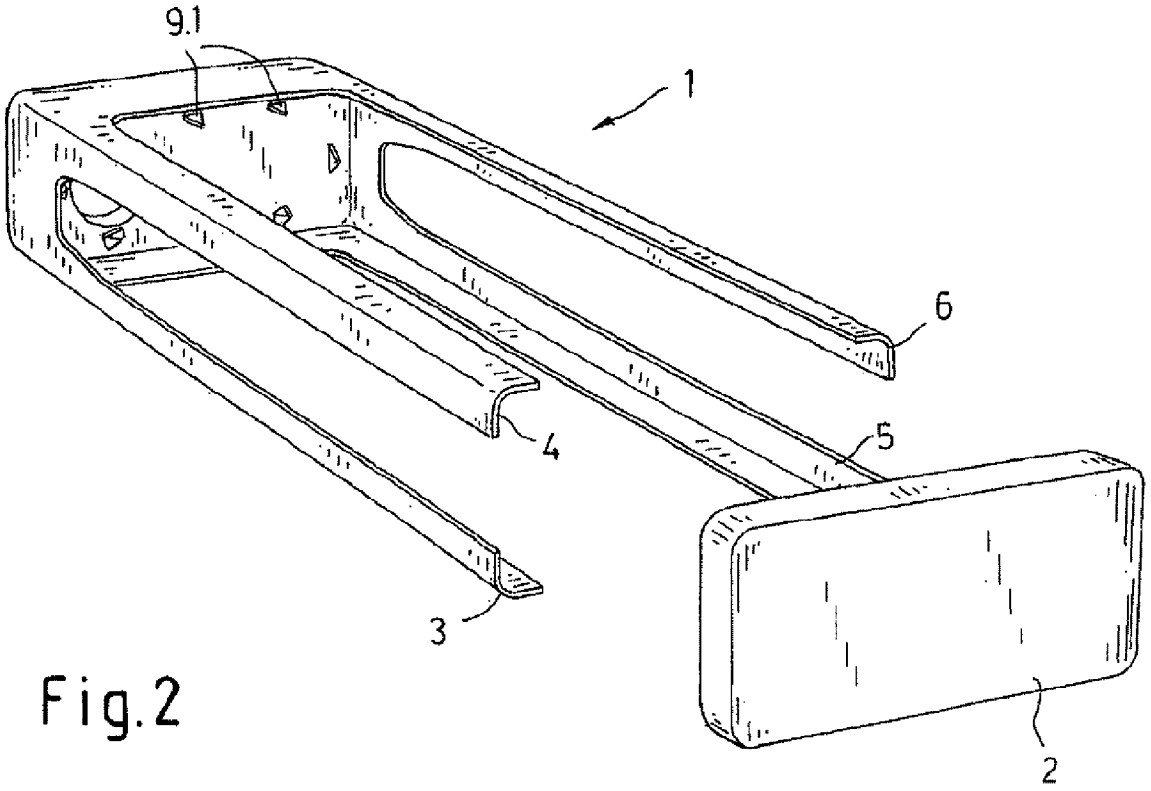

FIG. 1 shows an explosive material container 1 provided with an incident-flow protective cap 2 in the form of a perspective illustration from the rear (i.e., viewed from the firing side 10), and FIG. 2 shows the same explosive material container 1 with the incident-flow protective cap 2, viewed from the front (i.e., viewed from the ejection side 20). The protective, supporting, guidance and/or positioning function of the assembly is integrated in the explosive material container 1 and the incident-flow protective cap 2.

The cap 2, preferably provided with sealing and/or adhesive compound on an inner surface, is plugged onto two or more edge profiles 3, 4, 5, 6 forming a first portion 30 of the explosive material container 1 (as shown in FIGS. 1 and 2), on the ejection side on the explosive material block 7 packed in protective film 8. Thus, the cap 2 serves as an incident flow protector that prevents the explosive material of the explosive material block 7 from being torn apart by an airstream when it leaves the explosive material container 1 from a shell, magazine, and the like.

Furthermore, the cap 2 and the explosive material container 1 preferably have positioning spikes 9, 9.1, respectively, in the form of spikes. These result in the explosive compound block 7 being centered in the cap 2 and in the explosive material container 1, and being held in the optimum position for operation.

As shown in FIG. 1, the explosive material container 1 has a firing side 10 that is provided with a second portion 40 of the container 1, wherein the second portion 40 is integrally attached to the first portion 30. The second portion 40 includes a cup portion 42 or "ignition transfer cup" formed therein, wherein the ignition transfer cup is configured to receive a firing stemming charge (not shown). At the base of the ignition transfer cup 40, a firing channel is formed through which a firing mechanism (not shown, and which includes the firing stemming charge) is operably connected to the explosive material container 1 so it may ignite the explosive compound of the explosive compound block 7.

When fully assembled, the explosive material block 7, which is comprised of explosive material and is covered by protective film 8, is put into the explosive material container 1. The incident-flow protective cap 2 has positioning spikes 9 that center the block 7 and, at the same time, serve as a guard.

The invention claimed is:

1. An explosive material container having an explosive material block contained therein, wherein the explosive material container comprises:

(a) a first portion comprising a plurality of edge profiles, wherein each of the plurality of edge profiles comprises an elongated angle bracket, wherein each of the elongated angle brackets extends separately from a second portion of the explosive material container, the plurality of brackets being arranged to hold the explosive material block; and (b) an incident-flow protective cap connected to the first portion and disposed to protect the explosive material block from incident-flow when the explosive material block leaves the explosive material container, wherein the explosive material block is packed in a protective film, and the incident-flow protective cap is fitted over the protective film of the explosive material block, wherein the first portion of the explosive material container, in conjunction with the incident-flow protective cap, intrinsically carries out a protective, supporting, guidance and positioning function with respect to the explosive material block, and wherein plurality of positioning spikes are disposed on the incident-flow protective cap and on the first portion of the explosive material container in order to carry out the positioning function with respect to the explosive material block.

2. The explosive material container as claimed in claim 1, wherein the incident-flow cap is provided with a sealing compound, or an adhesive compound, or a sealing and adhesive compound, and is plugged onto two or more edge profiles of the plurality of edge profiles of the explosive material container, wherein the explosive material container has an ejection side and a firing side, wherein the incident-flow cap is plugged onto the two or more edge profiles on the ejection side and on the explosive material block.

3. The explosive material container as claimed in claim 2, wherein the first portion of the explosive material container, in conjunction with the incident-flow protective cap, intrinsically carries out a protective, supporting, guidance and positioning function with respect to the explosive material block.

4. The explosive material container as claimed in claim 1, further comprising:

(c) a second portion attached to the first portion, wherein the second portion is disposed on a firing side of the explosive material container and the second portion includes a cup portion.

5. The explosive material container as claimed in claim 4, wherein a firing channel is formed in the base of the cup portion.

6. The explosive material container as claimed in claim 4, wherein the incident-flow cap is provided with a sealing compound, or an adhesive compound, or a sealing and adhesive compound, and is plugged onto two or more edge profiles of the plurality of edge profiles of the explosive material container, wherein the explosive material container has an ejection side and a firing side, wherein the incident-flow cap is plugged onto the two or more edge profiles on the ejection side and on the explosive material block.

7. The explosive material container as claimed in claim 6, wherein the first portion of the explosive material container, in conjunction with the incident-flow protective cap, intrinsically carries out a protective, supporting, guidance and positioning function with respect to the explosive material block.

8. The explosive material container as claimed in claim 4, wherein the first portion of the explosive material container, in conjunction with the incident-flow protective cap, intrinsically carries out a protective, supporting, guidance and positioning function with respect to the explosive material block.

9. The explosive material container as claimed in claim 1, wherein the plurality of edge profiles consists of four elongated angle brackets each having an L-shaped cross section.

10. The explosive material container according to claim 1, wherein each of the elongated angle brackets has an L-shaped cross section.

11. An explosive material container having an explosive material block contained therein, wherein the explosive material container comprises:

(a) a first portion comprising a plurality of edge profiles, wherein each of the plurality of edge profiles comprises an elongated angle bracket, wherein each of the elongated angle brackets extends separately from a second portion of the explosive material container, the plurality of brackets being arranged to hold the explosive material block;

(b) an incident-flow protective cap connected to the first portion and disposed to protect the explosive material block from incident-flow when the explosive material block leaves the explosive material container, wherein the explosive material block is packed in a protective film, and the incident-flow protective cap is fitted over the protective film of the explosive material block; and (c) a second portion attached to the first portion, wherein the second portion is disposed on a firing side of the explosive material container and the second portion includes a cup portion, wherein the first portion of the explosive material container, in conjunction with the incident-flow protective cap, intrinsically carries out a protective, supporting, guidance and positioning function with respect to the explosive material block, and wherein a plurality of positioning spikes are disposed on the incident-flow protective cap and on the first portion of the explosive material container in order to carry out the positioning function with respect to the explosive material block.

12. An explosive material container having an explosive material block contained therein, wherein the explosive material container comprises:

(a) a first portion comprising a plurality of edge profiles, wherein each of the plurality of edge profiles comprises an elongated angle bracket, wherein each of the elongated angle brackets extends separately from a second portion of the explosive material container, the plurality of brackets being arranged to hold the explosive material block; and (b) an incident-flow protective cap connected to the first portion and disposed to protect the explosive material block from incident-flow when the explosive material block leaves the explosive material container, wherein the explosive material block is packed in a protective film, and the incident-flow protective cap is fitted over the protective film of the explosive material block, wherein the incident-flow cap is provided with a sealing compound, or an adhesive compound, or a sealing and adhesive compound, and is plugged onto two or more edge profiles of the plurality of edge profiles of the explosive material container, wherein the explosive material container has an ejection side and a firing side, wherein the incident-flow cap is plugged onto the two or more edge profiles on the ejection side and on the explosive material block, wherein the first portion of the explosive material container, in conjunction with the incident-flow protective cap, intrinsically carries out a protective, supporting, guidance and positioning function with respect to the explosive material block, and wherein a plurality of positioning spikes are disposed on the incident-flow protective cap and on the first portion of the explosive material container in order to carry out the positioning function with respect to the explosive material block.

13. An explosive material container having an explosive material block contained therein, wherein the explosive material container comprises:

(a) a first portion comprising a plurality of edge profiles, wherein each of the plurality of edge profiles comprises an elongated angle bracket, wherein each of the elongated angle brackets extends separately from a second portion of the explosive material container, the plurality of brackets being arranged to hold the explosive material block;

(b) an incident-flow protective cap connected to the first portion and disposed to protect the explosive material block from incident-flow when the explosive material block leaves the explosive material container, wherein the explosive material block is packed in a protective film, and the incident-flow protective cap is fitted over the protective film of the explosive material block; and (c) a second portion attached to the first portion, wherein the second portion is disposed on a firing side of the explosive material container and the second portion includes a cup portion, wherein the incident-flow cap is provided with a sealing compound, or an adhesive compound, or a sealing and adhesive compound, and is plugged onto two or more edge profiles of the plurality of edge profiles of the explosive material container, wherein the explosive material container has an ejection side and a firing side, wherein the incident-flow cap is plugged onto the two or more edge profiles on the ejection side and on the explosive material block, wherein the first portion of the explosive material container, in conjunction with the incident-flow protective cap, intrinsically carries out a protective, supporting, guidance and positioning function with respect to the explosive material block, and wherein a plurality of positioning spikes are disposed on the incident-flow protective cap and on the first portion of the explosive material container in order to carry out the positioning function with respect to the explosive material block.

* * * * *